US005500489A

United States Patent [19]

Shah et al.

[11] Patent Number: 5,500,489

[45] Date of Patent: Mar. 19, 1996

[54] CABLE FOR ELECTRONIC RETAILING APPLICATIONS

[75] Inventors: Dinesh T. Shah, Kernersville; Michael J. Rubera, Greensboro, both of N.C.

[73] Assignee: The Whitaker Corporation, Wilmington, Del.

[21] Appl. No.: 280,629

[22] Filed: Jul. 26, 1994

[51] Int. Cl.[6] ..... H01B 7/08

[52] U.S. Cl. ..... 174/117 FF; 174/117 A; 174/121 A

[58] Field of Search ..... 174/117 F, 117 FF, 174/117 A, 121 A

[56] References Cited

U.S. PATENT DOCUMENTS

| | | | |
|---|---|---|---|
| 3,579,206 | 5/1971 | Grange | 340/173.1 |
| 4,098,628 | 7/1978 | Walton | 156/52 |
| 4,213,028 | 7/1980 | Wolf | 219/203 |
| 4,460,804 | 7/1984 | Svejkovsky | 174/117 A |
| 4,486,649 | 12/1984 | Lane, Jr. | 219/536 |
| 4,605,818 | 8/1986 | Arroyo et al. | 174/107 |
| 4,640,981 | 2/1987 | Dery et al. | 174/88 R |
| 4,642,421 | 2/1987 | Dery et al. | 174/88 R |
| 4,659,872 | 4/1987 | Dery et al. | 174/117 A |
| 4,783,578 | 11/1988 | Bodensiek et al. | 174/117 F |
| 4,783,579 | 11/1988 | Brandolf et al. | 174/117 FF |
| 4,812,135 | 3/1989 | Smith | 439/493 |
| 4,864,081 | 9/1989 | Bates | 174/88 R |
| 4,922,323 | 5/1990 | Potter | 357/71 |
| 4,926,007 | 5/1990 | Aufderheide et al. | 174/36 |
| 5,001,304 | 3/1991 | Hardin et al. | 174/107 |
| 5,010,210 | 4/1991 | Sidi et al. | 174/34 |
| 5,221,417 | 6/1993 | Basavanhally | 156/629 |
| 5,262,590 | 11/1993 | Lia | 174/36 |
| 5,274,195 | 12/1993 | Murphy et al. | 174/117 FF |
| 5,359,238 | 3/1995 | Och | 439/39 |
| 5,389,741 | 4/1995 | Ueno | 174/117 F |

FOREIGN PATENT DOCUMENTS

| | | | |
|---|---|---|---|
| 2300986 | 7/1974 | Germany | 174/117 A |
| 265410 | 10/1989 | Japan | 174/117 A |

*Primary Examiner*—Morris H. Nimmo

[57] ABSTRACT

A flat cable 1 comprises, a ribbon (5) of dielectric material, electrical conductors (2, 3, 4) on one side only of the ribbon (5), a jacket 6) of flame resistant insulative material enclosing the ribbon (5) and the conductors (2, 3, 4), the ribbon (5) and the conductors (2, 3, 4) projecting from opposite ends of the jacket (6) for connection to electrical connectors.

5 Claims, 1 Drawing Sheet

CABLE FOR ELECTRONIC RETAILING APPLICATIONS

FIELD OF THE INVENTION

An electrical cable comprises, multiple conductors extending along a broad surface of a flexible ribbon, an outer, flexible jacket of insulating material enclosing the ribbon and the conductors, weakened areas in the jacket spaced apart along a length of the jacket to open the jacket and expose the conductors extending continuously under the weakened areas in the jacket.

BACKGROUND OF THE INVENTION

In the field of retail sales, goods such as groceries are presented on shelves for sale. Presently, labels are applied to the shelves to accompany the goods, and to indicate price, inventory and other relevant information. As prices and other information quickly become obsolete, manual labor must be available on a continuing basis to replace the labels. In the future, manually applied labels will be supplanted by new technology, residing in electronically activated, visual display strips extending along the shelves and displaying electronically generated information. In response to the anticipated, new technology, the present invention resides in an electrical cable adapted to electrically interconnect the shelves on which the electronic strips are mounted. A low cost, high impact strength cable is required for withstanding impact by grocery carts and impact by fallen goods that have tumbled from the shelves. A thin cable is required to fit into crevices and to route around sharp bends.

SUMMARY OF THE INVENTION

An electrical cable comprises, a thin and flexible ribbon on which are located, thin and flexible conductors, and an outer insulating jacket containing the conductors and the ribbon.

An advantage of the invention resides in a thin, flexible electrical cable that has an outer jacket that is readily stripped along weakened areas of the jacket.

Another advantage of the invention resides in a flexible ribbon on which electrical conductors are located, and an outer jacket that encloses the ribbon and the conductors, and which jacket is readily stripped to protrude the ribbon and the conductors for ease in termination of the conductors.

According to an embodiment of the invention, the conductors and the ribbon are continuous along a length of the jacket. Multiple weakened areas of the jacket, spaced along the length of the jacket, adapt the jacket to be opened along any of the weakened areas to expose the conductors and the ribbon.

An embodiment of the jacket allows the jacket to be stripped along any of the weakened areas to protrude the conductors and the ribbon from the remaining portion of the jacket for ease in electrical termination of the conductors.

An embodiment of the invention will now be described, by way of example, with reference to the drawings, according to which;

DETAILED DESCRIPTION

Figure 1:
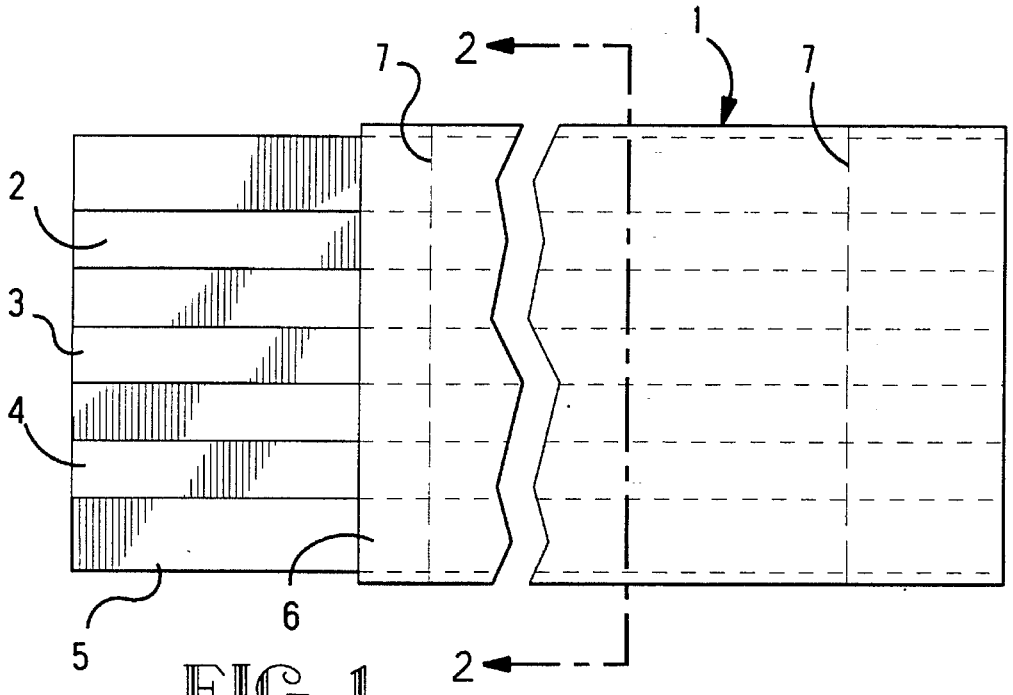
FIG. 1 is a top plan view of a portion of a continuous electrical cable cut to a first length, and an outer jacket continuously along the cable, a part of the jacket being removed to expose the cable.

With reference to the drawings, an electrical cable 1 comprises, multiple flat and flexible conductors 2, 3, 4 attached to, and extending along, a broad surface of a flexible ribbon 5, an outer, flexible jacket 6 of insulating material enclosing the ribbon 5 and the conductors 2, 3, 4, and weakened areas 7 in the jacket 6, obtained by scoring the jacket 6. These areas 7 are spaced apart along a length of the jacket 6 to open the jacket 6 and expose the conductors 2, 3, 4 extending continuously under the weakened areas 7 in the jacket 6.

Although a portion of the cable 1 is shown in FIG. 1, the cable 1 is intended to be continuous in length, as manufactured. The weakened areas 7 extend solely in the jacket 6, leaving the ribbon 5 and the conductors 2, 3, 4 to extend continuously without such weakened areas 7. Each of the weakened areas 7 extends circumferentially across the length of the jacket 6 and through the thickness of the jacket 6.

Figure 2:
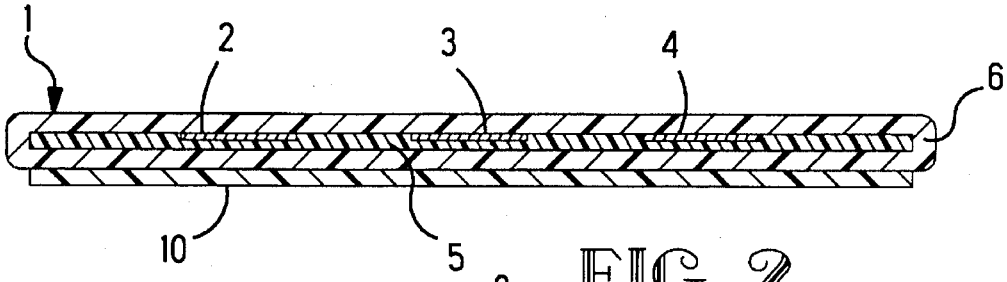
FIG. 2 is a cross section of the cable taken along the line 2—2 of FIG. 1.

With reference to FIG. 2, stripping of the jacket 6 is accomplished by severing the jacket 6 along the weakened areas 7 and through its thickness along each one of the weakened areas 7, without severing also the ribbon 5 and the conductors 2, 3, 4 that extend through the weakened area 2, 3, 4.

Figure 3:
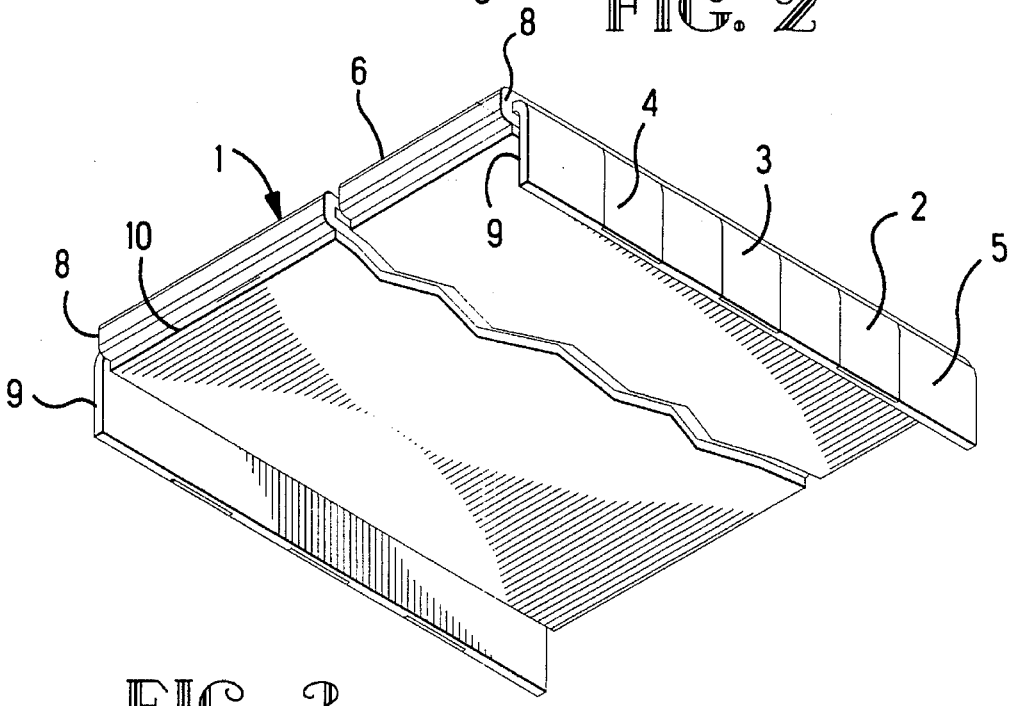
FIG. 3 is a view of the cable as shown in FIG. 1, with bent ends, and an outer jacket cut to a shorter length than the cable to expose conductors of the cable.

The cable 1 is constructed as a flat flexible cable with copper traces on one side only of a flexible ribbon 5 of insulative material such as Kapton. The traces are on an external surface of the ribbon 5. The traces form the three conductors 2, 3, 4 that are on 0.100 centerlines, for example. A flame resistant material, for example, of Polyvinyl Chloride, is applied by extrusion over both sides of the ribbon 5 to enclose the conductors 2, 3, 4 and the insulative material of the ribbon 5. The ribbon 5 and the conductors 2, 3, 4 cable can be exposed at any length along the jacket 6, by cutting the cable 1 and the jacket 6 to a first length, extending longer than the distance between two of the weakened areas 7 as shown in FIG. 1. Then the jacket 6 is cut to a shorter length by scoring and cutting away the jacket 6, along the two weakened areas 7 to provide opposite open ends 8 of the jacket, FIG. 3. Exposed ends 9 of the conductors 2, 3, 4 and the ribbon 5 project outwardly from the open ends 8 of the jacket 6, FIG. 3. The exposed ends 9 are bent ninety degrees to prevent a pull on the cable 1 that would cause the cable 1 to become dislodged from an electrical connector, not shown.

A pressure sensitive adhesive 10 is applied to a length 11 of the jacket 6 that remains after cutting, between the folded ends 9 for surface mounting of the jacket 6. The adhesive 10 allows the length 11 of the jacket 6 to adhere to a surface, such as an edge of a grocery shelf, not shown. The ends 9 of the cable 1 are at opposite ends of the shelf, and are adapted to plugged in electrical connectors, not shown, at opposite ends of the shelf. The adhesive 10 is on one side only of the jacket 6, which jacket 6 covers the conductors 2, 3, 4. Each of the exposed ends 9 of the ribbon 5 and the conductors 2, 3, 4 are bent in an arc toward a direction inwardly toward each other and inwardly toward opposite ends of the shelf. The ribbon 5 covers and protects the conductors 2, 3, 4 until they are plugged into an electrical connector.

The jacket 6 protects the conductors 2, 3, 4 and the ribbon 5 of the cable 1 from abrasion by movement of grocery items displayed on the shelf. The jacket 6 also protects the conductors 2, 3, 4 and the ribbon 5 from impact by falling grocery items displayed on the grocery shelves.

We claim:

1. A flat cable comprising: a ribbon of dielectric material, electrical conductors on one side only of the ribbon and on an external surface of the ribbon, a jacket of flame resistant insulative material enclosing the ribbon and the conductors, the ribbon and the conductors being cut to a first length, the jacket being cut to a second length shorter than the first length, and exposed ends of the conductors and also of the ribbon projecting from opposite ends of the jacket for connection to electrical connectors.

2. A flat cable as recited in claim 1 wherein, the exposed ends are bent with respect to a length of cable between the exposed ends.

3. A flat cable as recited in claim 1 comprising: an adhesive material on a length of the jacket between the exposed ends for surface mounting the jacket.

4. A flat cable as recited in claim 1 wherein, the exposed ends are bent to extend in the same direction, and the conductors protruding from the jacket face outwardly toward each other.

5. A flat cable as recited in claim 1 wherein, adhesive material on one side only of the jacket is between the exposed ends for surface mounting the jacket.

* * * * *